US012774571B2

(12) United States Patent
Hutar et al.

(10) Patent No.: US 12,774,571 B2
(45) Date of Patent: Oct. 27, 2026

(54) SERVICEABLE MILLING DRUM LOAD SUPPORT

(71) Applicant: Caterpillar Paving Products Inc., Brooklyn Park, MN (US)

(72) Inventors: Ryan Hutar, Plymouth, MN (US); Craig T. Hedstrom, Mounds View, MN (US); Nicholas B. Johnson, Dayton, MN (US); Mario Persano, Poggio Renatico (IT)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 355 days.

(21) Appl. No.: 18/223,746

(22) Filed: Jul. 19, 2023

(65) Prior Publication Data

US 2025/0027280 A1 Jan. 23, 2025

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E01C 23/088; E01C 23/127
See application file for complete search history.

(56) References Cited

U.S. PATENT DOCUMENTS

| | | | | |
|---|---|---|---|---|
| 4,720,207 | A * | 1/1988 | Salani | E01C 23/088 404/90 |
| 7,144,192 | B2 | 12/2006 | Holl et al. | |
| 8,474,919 | B2 * | 7/2013 | Cipriani | B28D 1/18 299/39.4 |
| 8,770,668 | B2 | 7/2014 | Hall et al. | |
| 8,985,702 | B2 * | 3/2015 | Busley | E01C 23/088 299/39.4 |
| 9,234,320 | B2 * | 1/2016 | Abresch | E01C 23/127 |
| 9,903,201 | B2 * | 2/2018 | Mitterndorfer | E21C 25/10 |
| 10,794,018 | B2 | 10/2020 | Hirman et al. | |
| 11,674,273 | B2 * | 6/2023 | Hutar | E01C 23/088 299/39.4 |
| 2007/0228806 | A1 * | 10/2007 | Holl | B28D 1/186 299/39.4 |

FOREIGN PATENT DOCUMENTS

| | | |
|---|---|---|
| DE | 10232489 A1 | 1/2004 |
| DE | 102022003914 A1 | 4/2023 |
| EP | 2350391 | 1/2018 |

* cited by examiner

*Primary Examiner* — Janine M Kreck

(57) ABSTRACT

A milling machine can include a frame, a milling assembly coupled to the frame, the milling assembly including a rotor housing and a cutting rotor, the cutting rotor including a rotor shell positioned around a spindle, and a removable support ring positioned on an inner surface of the rotor shell, wherein the support ring is positioned between the rotor shell and the spindle, wherein the support ring is separate from the rotor shell and carries a load of the rotor shell from the spindle.

14 Claims, 8 Drawing Sheets

SERVICEABLE MILLING DRUM LOAD SUPPORT

TECHNICAL FIELD

The present disclosure generally relates to a milling machine. More particularly, the present disclosure relates to a system and method to service the cutting rotor of the milling machine.

BACKGROUND

Milling machines can include machines such as cold planers and reclaimers. Cold planers are powered machines used to remove at least part of a surface of a paved area such as a road, bridge, or parking lot. Typically, cold planers include a frame, a power source, a milling assembly positioned below the frame, and a conveyor system. The milling assembly includes a milling drum or cutting rotor having numerous cutting bits disposed thereon. As power from the power source is transferred to the milling assembly, this power is further transferred to the cutting rotor, thereby rotating the cutting rotor about its axis. As the cutting rotor rotates, its cutting bits engage the hardened asphalt, concrete or other materials of an existing surface of a paved area, thereby removing layers of these existing structures. The spinning action of the cutting bits transfers these removed layers to the conveyor system which transports the removed material to a separate powered machine such as a haul truck for removal from a work site.

During a milling process, it may be desirable to switch between cutting rotor having different widths or different pitches. Different cutting rotors are utilized to attain varying finished surfaces depending on the requirements of each jobsite. As a milling machine can frequently change cutting rotors, it is important that the assembly and disassembly process is both efficient and reliable. The ability to service or change out any components that carry the radial load of the cutting rotor can allow for quick cutting rotor changeout throughout the machine life.

EP 2350391 discusses a road milling machine having changeable milling drums with different cutting widths.

SUMMARY

In an example according to this disclosure, a milling machine can include a frame, a milling assembly coupled to the frame, the milling assembly including a rotor housing and a cutting rotor, the cutting rotor including a rotor shell positioned around a spindle, and a removable support ring positioned on an inner surface of the rotor shell, wherein the support ring is positioned between the rotor shell and the spindle, wherein the support ring is separate from the rotor shell and carries a load of the rotor shell from the spindle.

In one example, a milling assembly can include a cutting rotor and a rotor housing, the cutting rotor including a rotor shell positioned around a spindle, and a removable support ring positioned on an inner surface on a drive side of the rotor shell, wherein the support ring is positioned between the rotor shell and the spindle, wherein the support ring is separate from the rotor shell and carries a load of the rotor shell from the spindle, wherein the rotor shell and the spindle do not articulate against each other such that the support ring is a load carrying surface and not a bearing surface.

In one example, a method of mounting a rotor shell to a spindle of a cutting rotor of a milling machine can include attaching a removable support ring to an inner surface of a rotor shell, and positioning the rotor shell over a spindle such that the support ring is positioned between the rotor shell and the spindle, wherein the support ring is separate from the rotor shell and carries a load of the rotor shell from the spindle.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
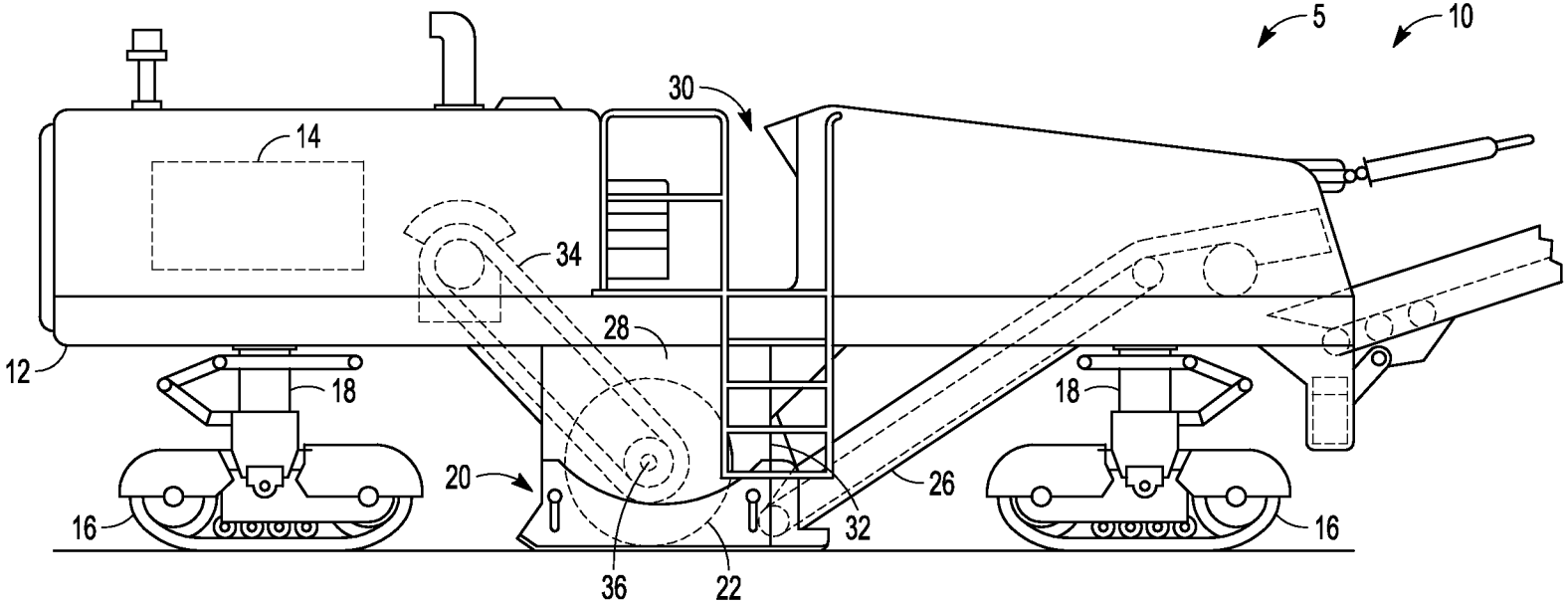
FIG. 1 shows a side view of a cold planer, in accordance with one embodiment.

FIG. 1 shows a side view of a milling machine 5, in accordance with one embodiment. In this example, the milling machine 5 is a cold planer 10. The cold planer 10 includes a frame 12, and a power source 14 connected to the frame 12. The power source 14 may be provided in any number of different forms including, but not limited to, Otto and Diesel cycle internal combustion engines, electric motors, hybrid engines and the like.

The frame 12 is supported by transportation devices 16 via lifting columns 18. The transportation devices 16 may be any kind of ground-engaging device that allows the cold planer 10 to move in a forward direction over a ground surface, for example a paved road or a ground already processed by the cold planer 10. For example, in the shown embodiment, the transportation devices 16 are configured as track assemblies. The lifting columns 18 are configured to raise and lower the frame 12 relative to the transportation devices and the ground.

The cold planer 10 further includes a milling assembly 20 connected to the frame 12. The milling assembly 20 includes a rotor housing 28 holding a rotatable milling drum or cutting rotor 22 operatively connected to the power source 14 via a drive belt 34 which drives a sheave drive 36 coupled to a drive side of the cutting rotor 22. The cutting rotor 22 can be rotated about a drum or housing axis extending in a direction perpendicular to the longitudinal frame axis. As the rotatable cutting rotor 22 spins about its drum axis, cutting bits on the cutting rotor 22 can engage hardened materials, such as, for example, asphalt and concrete, of existing roadways, bridges, parking lots and the like. As the cutting bits engage such hardened materials, the cutting bits remove layers of these hardened materials. The spinning action of the rotatable drum 22 and its cutting bits then transfers the hardened materials to a first stage conveyor 26 via a discharge port 32 on the rotor housing 28. The first stage conveyor 26 can be coupled to the frame 12 and located at or near the discharge port 32.

The rotor housing 28 includes front and rear walls, and a top cover positioned above the cutting rotor 22. Furthermore, the rotor housing 28 includes lateral covers on the left and right sides of the cutting rotor 22 with respect to a travel direction of the cold planer 10. The rotor housing 28 is open toward the ground so that the cutting rotor 22 can engage in the ground from the rotor housing 28. The rotor housing includes the discharge port 32 in a front wall to discharge material to the first stage conveyor 26.

The cold planer 10 further includes an operator station or platform 30 including an operator interface for inputting commands to a control system for controlling the cold planer 10, and for outputting information related to an operation of the cold planer 10.

Figure 2:
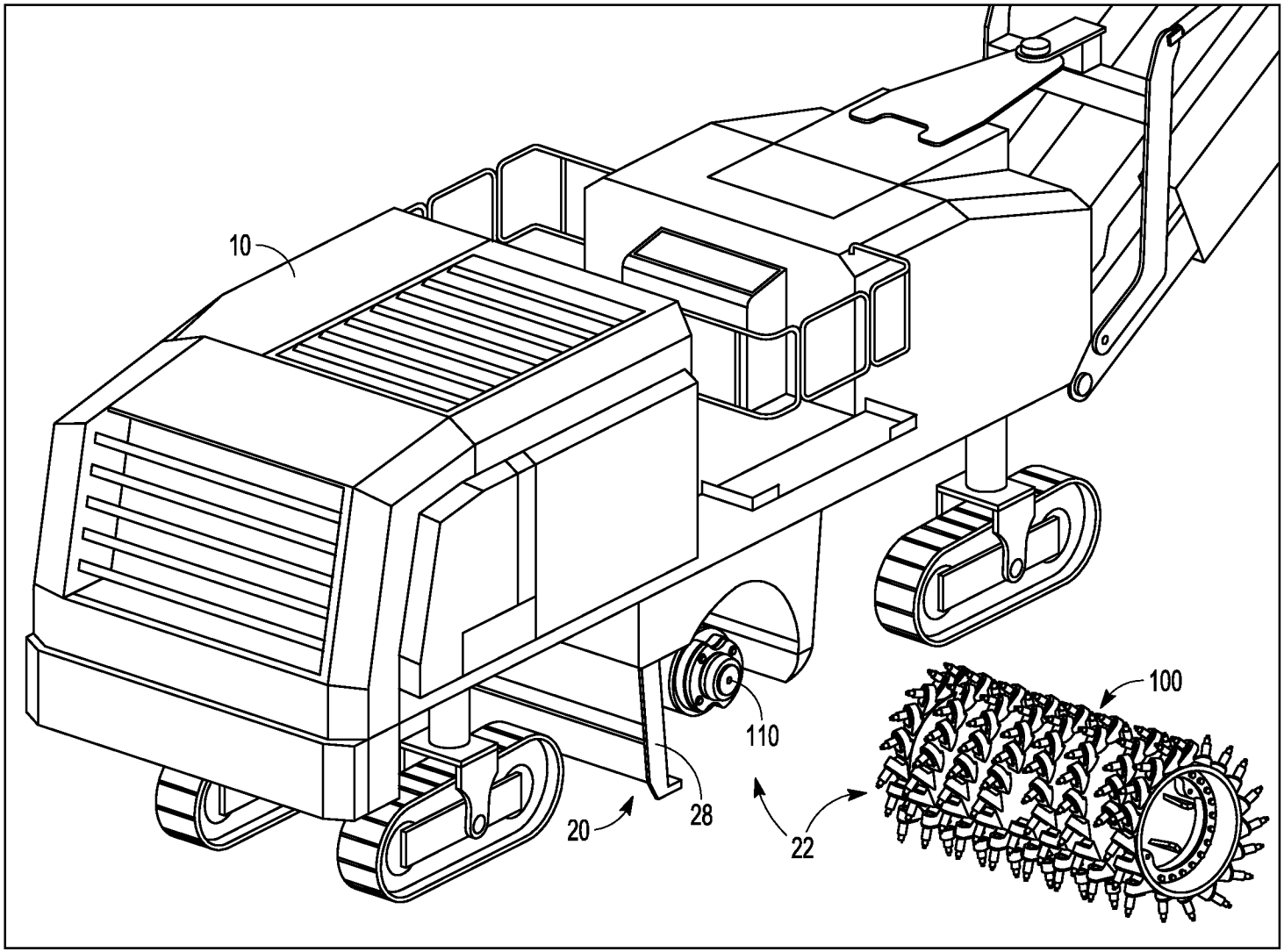
FIG. 2 shows a rear perspective view of the cold planer, in accordance with one embodiment.
Figure 3:
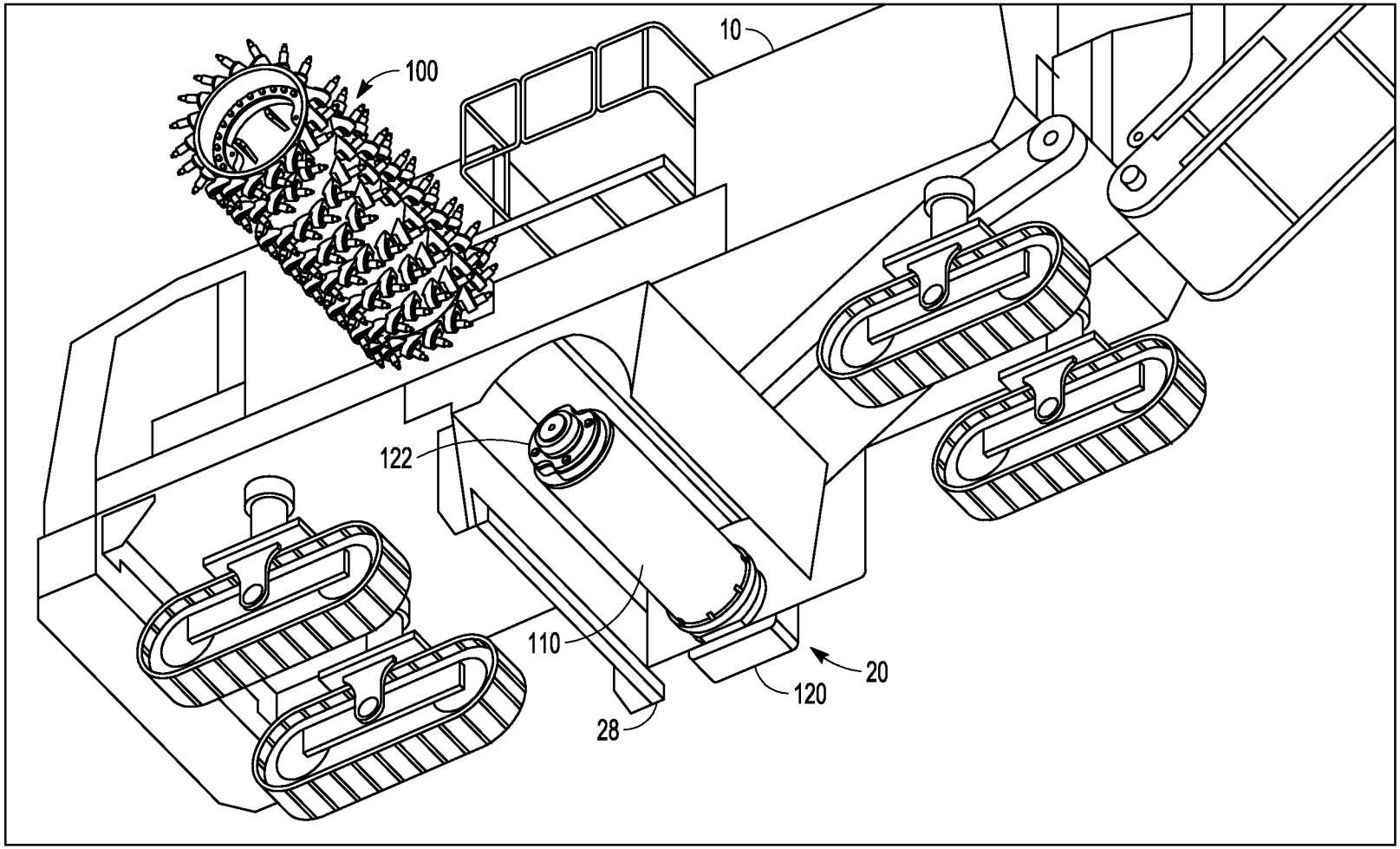
FIG. 3 shows a bottom perspective view of the cold planer of FIG. 2, in accordance with one embodiment.

FIG. 2 shows a rear perspective view of the cold planer 10, and FIG. 3 shows a bottom perspective view of the cold planer 10, in accordance with one embodiment.

Here, the cutting rotor 22 includes an outer rotor shell 100 positioned around an inner spindle 110. The spindle 110 is coupled to the machine 10 at a drive side 120 of the milling assembly 20. The drive side 120 can also be called the left-side in milling terminology. A non-drive side 122, or right side, of the milling assembly 20 is accessible to allow removal of the outer rotor shell 100 from the spindle 110 to allow for a different cutting rotor shell to be installed. For example, the different cutting rotor shell can have different pitch cutting teeth, a different cutting width, or other cutting characteristics.

When changing out rotor shells, the right-hand side plate of the rotor housing 28 is removed to expose the non-drive side 122 of the cutting rotor 22. The old rotor shell is taken off and the rotor shell 100 is then ready to be assembled over the spindle 110.

As noted above, in asphalt milling applications, different cutting rotors are utilized to attain varying finished surfaces depending on the requirements of each jobsite. As machines frequently change rotor shells, it is important that the assembly and disassembly process of the rotor shell 100 onto the spindle 110 is both efficient and reliable. It is advantageous to be able to easily and efficiently service the cutting rotor.

Figure 4:
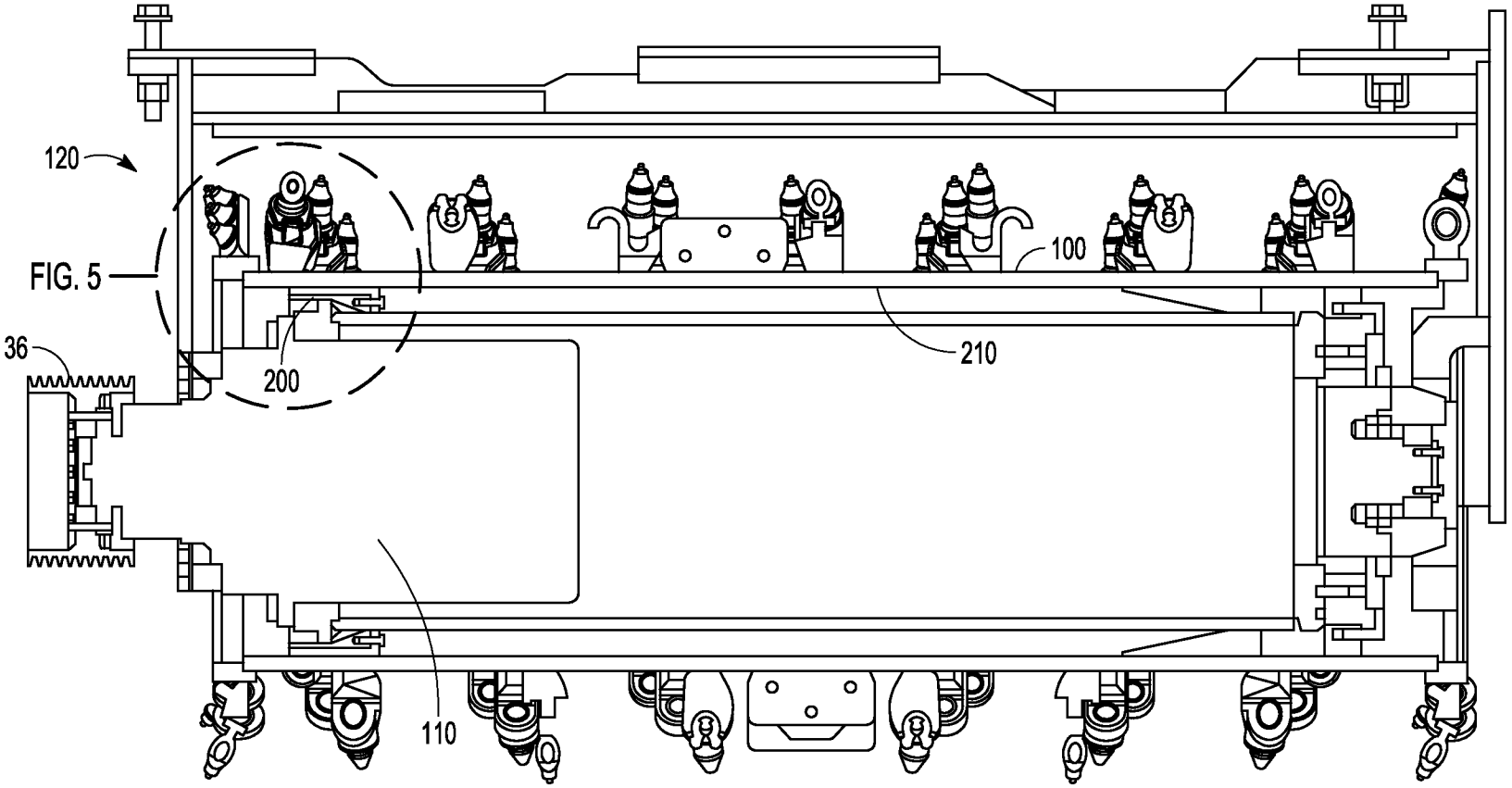
FIG. 4 shows a cross-section of a milling assembly, seen from behind, in accordance with one embodiment.
Figure 5:
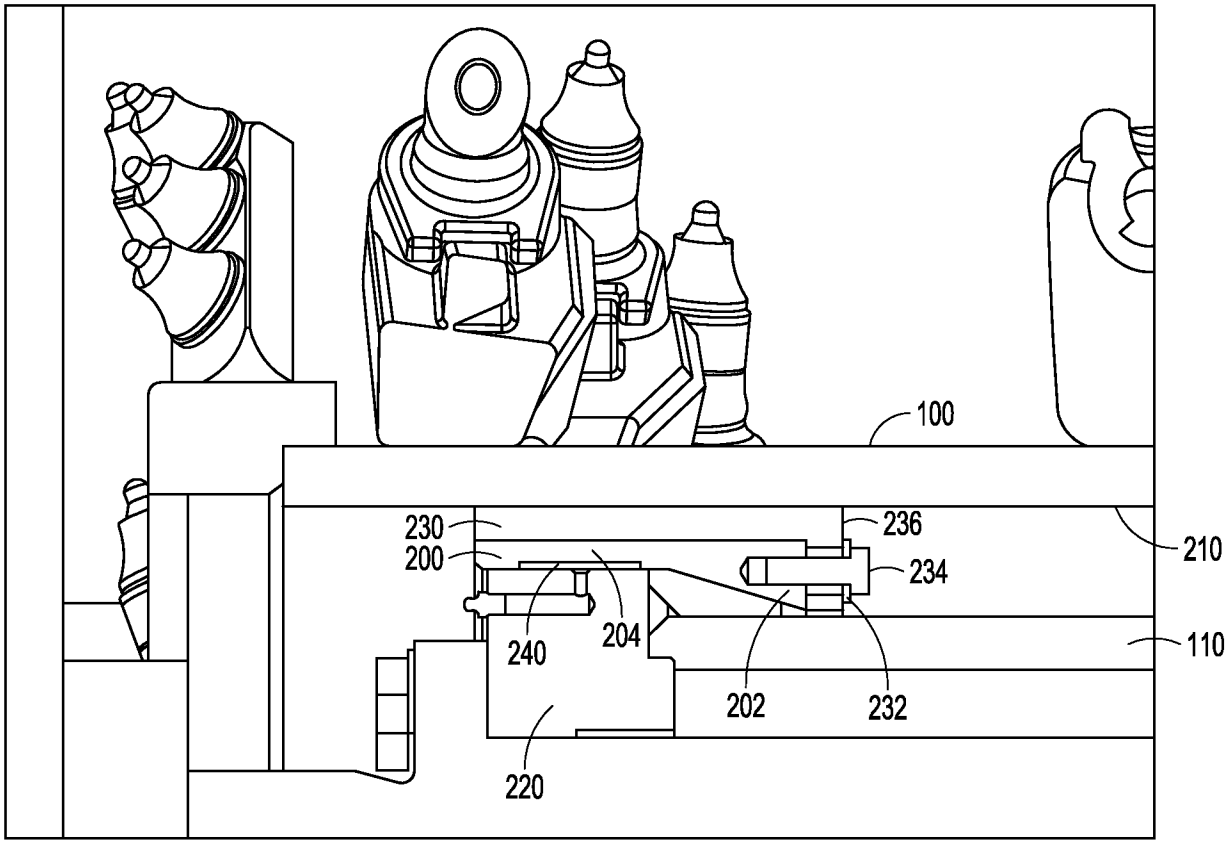
FIG. 5 shows a cross-section view of the support ring within the rotor shell of FIG. 4, in accordance with one embodiment.
Figure 6:
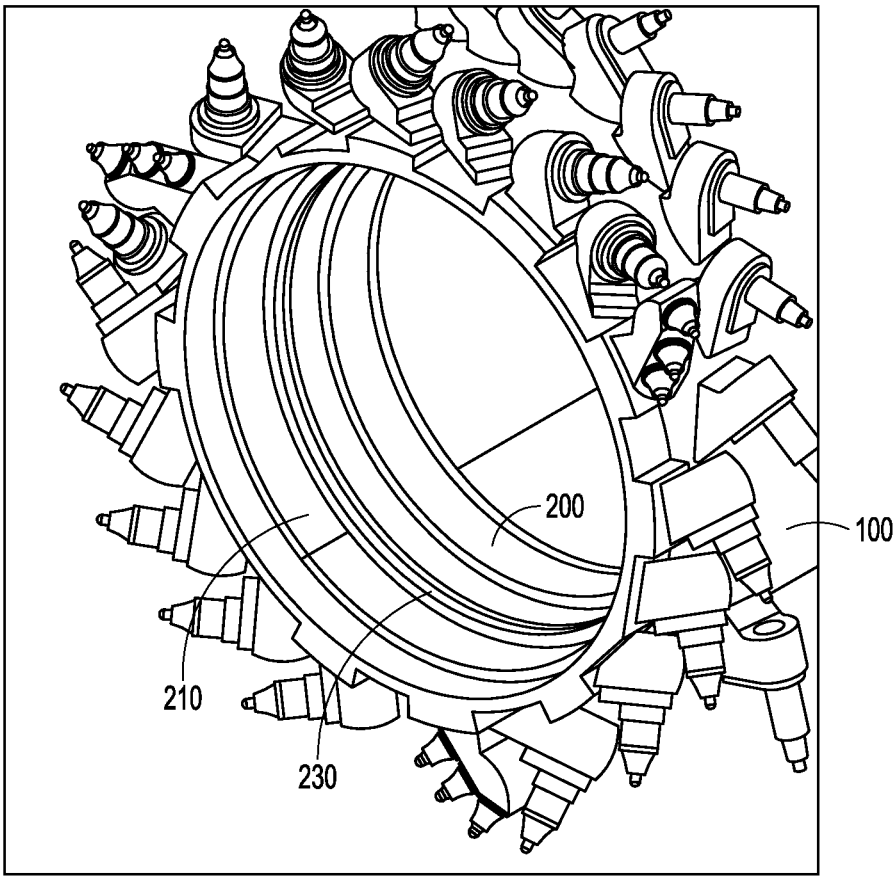
FIG. 6 shows a perspective view of the support ring installed in the rotor shell, in accordance with one embodiment.

Accordingly, FIGS. 4-6 shows a cutting rotor 22 including features to allow for the ability to service or change out some components that carry the load of the rotor shell.

FIG. 4 shows a cross-section of the milling assembly 20, in accordance with one embodiment; FIG. 5 shows a cross-section view of a support ring 200 within the rotor shell 100, in accordance with one embodiment; and FIG. 6 shows a perspective view of the support ring 200 installed in the rotor shell 100, in accordance with one embodiment.

The present system can include a serviceable, removable support ring 200 positioned on an inner surface 210 of the rotor shell 100. The support ring 200 is positioned between the rotor shell 100 and the spindle 110. The support ring 200 is separate from the rotor shell 100 and is designed and positioned to carry a load of the rotor shell 100 from the spindle 110. For example, the support ring can carry the radial or normal load of the rotor shell 100 from the spindle. In one example, a portion of the tangential load between the rotor shell 100 and the spindle 11 can also be supported by the support ring 200. In one embodiment, the interface between the spindle 110 and the rotor shell 100 can include a spindle interface member 220 coupled to an outer surface of the spindle 110. The spindle interface member 220 contacts the support ring 200. This contacting interface is where the radial load is carried between the spindle 110 and the rotor shell 100. In one example, the support ring 200 can be located on the inner surface 210 of the rotor shell 100 at the drive side 120 of the rotor shell 100. The interface member 220 can be treated as a part of the spindle 110 when considering relative movement between the rotor shell 100 and the spindle 110.

In one embodiment, the support ring 200 can be positioned upon a mount member 230 that is welded to the inner surface 210 of the rotor shell 100. For example, the mount member 230 can be welded to the inner surface 210 of the rotor shell 100 and include a mounting hole 232 allowing a bolt 234 to bolt the support ring 200 in place upon the mount member 230. Here, the mount member 230 includes a flange 236 including the mounting hole 232. When assembled, the support ring 200 abuts the flange 236 of the mount member 230.

In this example, the support ring 200 includes a radially widened mounting portion 202 to allow the bolt 234 to bolt to the support ring 200, and a thinner axial load surface 204 where the spindle interface member 220 contacts the support ring 200. Bolting the support ring 200 to the mount member 230 allows the support ring 200 to be easily removed and serviced or replaced when worn or damaged. Thus, the rotor shell 100 can be removed from the spindle 110 and the support ring 200 can be accessed to be serviced or replaced. This is as opposed to having to service or replace the entire rotor shell 100. Since the support ring 200 bears the radial load, the support ring is a portion of the cutting rotor 22 that can experience more wear than other inner portions of the rotor shell 100.

In addition to bearing the load, the support ring 200 can further provide help for axial alignment of the rotor shell 100 and the spindle 110 when the rotor shell 100 is loaded onto the spindle 110. This can be accomplished by having suitably dimensioned facing surfaces on the support ring 200 and the spindle interface member 220. Additionally, those facing surfaces can have suitably-dimensioned tapers, which would further facilitate such axial alignment of the rotor shell 100 and the spindle 110.

In various examples, the support ring 200 can include a steel ring with a surface coating that is different than a surface of the inner surface 210 of the rotor shell 100. Since the serviceable support ring 200 is a separate part from the rotor shell 100, the physical characteristics of the support ring 200 can include separate processing than the rotor shell 100 such as hardening, carburization, an anti-rust coating, and other post-machining processes to harden and prevent rust, for example. In some examples, the post-machining processing can include a surface coating of the support ring 200 including at least one of a nickel coating, heat treatment, shot-peening, or other post-machine processes. Again, since the support ring 200 bears the radial load, the support ring is a portion of the cutting rotor 22 that can experience more wear than other inner portions of the rotor shell 100. By allowing for different post-machining processes, the support ring 200 can provide a better radial load surface than an inner surface of the rotor shell 100, which is not as easily serviced and cannot be replaced without replacing the entire rotor shell 100. Again, to service the support ring 200, the rotor shell 100 is removed from the spindle 110 and the support ring 200 can be accessed.

It is noted that the rotor shell 100 and the spindle 110 do not articulate against each other. Thus, the support ring 200 defines a load carrying surface and not a rotating bearing surface.

Accordingly, to provide for better serviceability of a cutting rotor, the present system includes a serviceable component on the inner surface of the flange of the rotor shell. This serviceable component can include the support ring 200 that is located on the gearbox drive side of the cutting rotor. The support ring 200 is configured to bear radial loads during operation of the cutting rotor 22. Moreover, the support ring 200 can also help axially align the rotor shell 100 into its working position on the spindle 110 to make installation more efficient. Since the component is serviceable, it will allow the rotor shell assembly and disassembly process to be efficient and reliable throughout the machine life. Additionally, this support ring 200 will allow the customer to change the part out if there is something that damages the rotor shell 100 when the rotor shell is not in service or even installed on the machine. This will prevent the customer from having to purchase the entire rotor shell in this instance.

Figure 7:
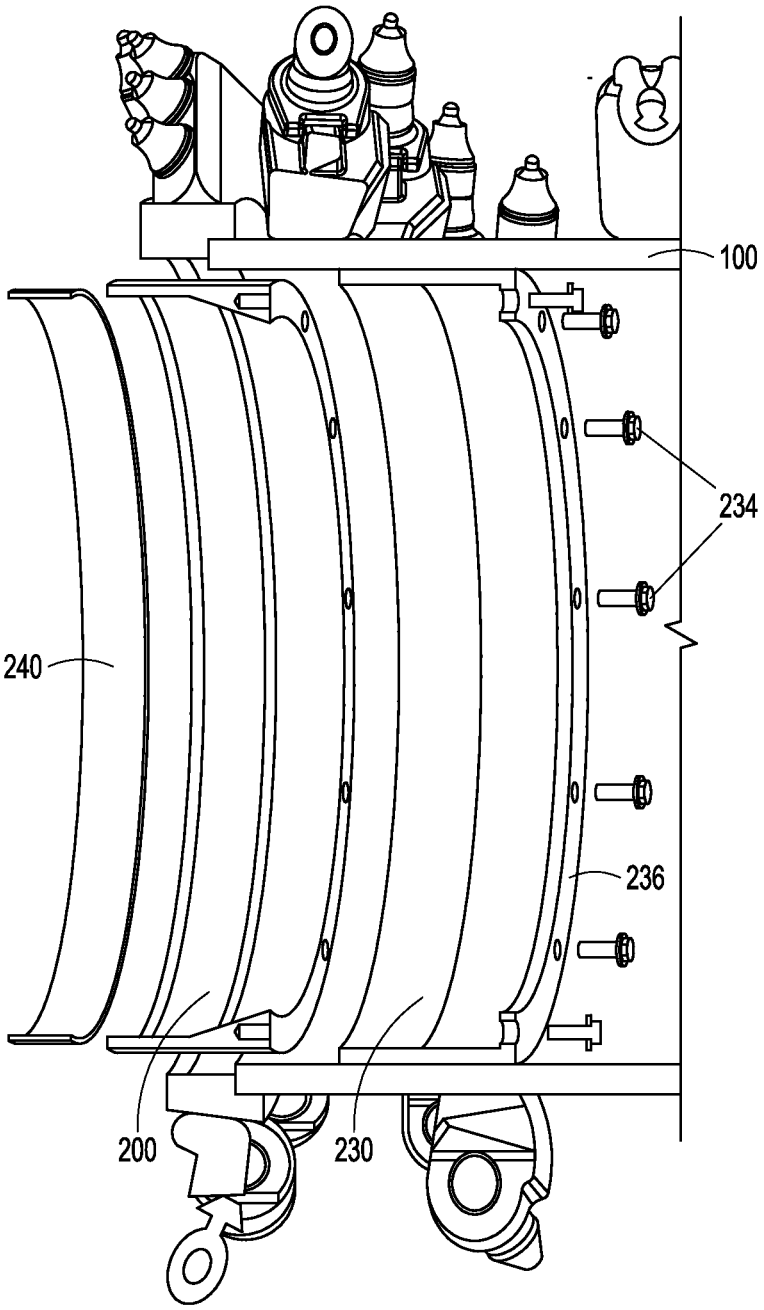
FIG. 7 shows an exploded perspective view of some components of the rotor shell, in accordance with one embodiment.

FIG. 7 shows an exploded perspective view of the components of the rotor shell 100, in accordance with one embodiment.

Here, the present system can further include a non-metallic bushing 240 which can include an annular ring positioned on the surface of the support ring 200 when assembled. (For example, referring to FIG. 5, the bushing 240 can be located between the support ring 200 and the spindle interface member 220). Thus, the bushing 240 can be positioned between the support ring 200 and the spindle 110.

In one example, the non-metallic bushing 240 can include a surface having a lower coefficient of friction than a surface of the support ring 200. The lower friction allows for easier sliding against the spindle interface member 220 when removing the rotor shell 100 from the spindle 110. This allows for easier removal of the rotor shell 100 from the spindle 110. In another example, the non-metallic bushing 240 can include a metal backing with a composite lining.

INDUSTRIAL APPLICABILITY

The present system is applicable to a milling assembly for a cold planer or a reclaimer. The milling assembly is suitable as a milling unit of a cold planer for removing at least part of a surface of a paved area such as a road, bridge, and a parking lot.

The present system includes a serviceable component on the inner surface of the flange of the rotor shell of a cutting rotor. The serviceable component is configured to bear the load between the rotor shell and the spindle during operation of the rotor shell.

Figure 8:
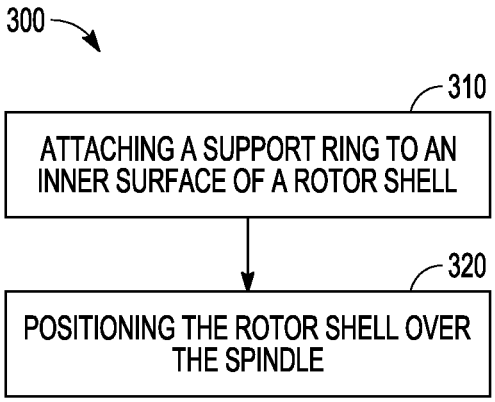
FIG. 8 shows a method of mounting a rotor shell to a spindle of a cutting rotor of a milling machine, in accordance with one embodiment.

FIG. 8 shows a method (300) of mounting a rotor shell to a spindle of a cutting rotor of a milling machine, in accordance with one embodiment.

The method (300) can include attaching a removable support ring to an inner surface of a rotor shell (310) and positioning the rotor shell over a spindle (320) such that the support ring is positioned between the rotor shell and the spindle, wherein the support ring is separate from the outer shell and carries a load of the rotor shell from the spindle.

In some examples, the support ring can include a steel ring with a surface coating that is different than a surface of the inner surface of the rotor shell. Again, since the support ring is a separate part so that the manufacturer can treat the support ring different than the rotor shell and change its physical characteristics, such as by hardening, or applying anti-rust coating. Accordingly, the serviceable support ring can include a material having a separate and different post-machining process than the rotor shell, for example.

In summary, different cutting rotors are utilized to attain varying finished surfaces depending on the requirements of each jobsite. The ability to service or change out the components of the rotor shell that carry the load of the rotor shell is an advantage and would allow for quick rotor shell changeout throughout the machine life. The support ring 200 of the present system increases installation efficiency during assembly and disassembly of the rotor shell of the cutting rotor since the support ring 200 is serviceable and, if the component is damaged, the support ring 200 may be removed from the rotor shell without replacing the rotor shell.

The above detailed description is intended to be illustrative, and not restrictive. The scope of the disclosure should, therefore, be determined with references to the appended claims, along with the full scope of equivalents to which such claims are entitled.

What is claimed is:

1. A milling machine comprising:

a frame;

a milling assembly coupled to the frame, the milling assembly including a rotor housing and a cutting rotor, the cutting rotor including a rotor shell positioned around a spindle; and a removable support ring positioned upon a mount member that is welded to an inner surface of the rotor shell, wherein the support ring is positioned between the rotor shell and the spindle, wherein the support ring is separate from the rotor shell and carries a load of the rotor shell from the spindle, and wherein the support ring has a different hardness than the rotor shell.

2. The milling machine of claim 1, wherein the support ring is located on the inner surface of the rotor shell at a drive side of the rotor shell.

3. The milling machine of claim 1, wherein the support ring further provides axial alignment of the rotor shell and the spindle when the rotor shell is loaded onto the spindle.

4. The milling machine of claim 1, wherein the support ring includes a steel ring with a surface coating that is different than a surface of the inner surface of the rotor shell.

5. The milling machine of claim 4, wherein the surface coating of the support ring includes at least one of a nickel coating, a heat-treated region, a shot-peening region, or an anti-rust coating.

6. The milling machine of claim 1, wherein the rotor shell and the spindle do not rotate relative to each other such that the support ring is a load carrying surface and not a bearing surface.

7. The milling machine of claim 1, further including a non-metallic bushing positioned between the support ring and the spindle.

8. The milling machine of claim 7, wherein the non-metallic bushing includes a surface having a lower coefficient of friction than a surface of the support ring.

9. A milling assembly comprising:

a cutting rotor and a rotor housing, the cutting rotor including a rotor shell positioned around a spindle;

a removable support ring positioned on an inner surface on a drive side of the rotor shell, wherein the support ring is positioned between the rotor shell and the spindle, wherein the support ring is separate from the rotor shell and carries a load of the rotor shell from the spindle, wherein the rotor shell and the spindle do not articulate against each other such that the support ring is a load carrying surface and not a bearing surface; and a non-metallic bushing positioned between the support ring and the spindle, wherein the non-metallic bushing includes a surface having a lower coefficient of friction than a surface of the support ring.

10. The milling assembly of claim 9, wherein the support ring includes a steel ring with a surface coating that is different than a surface of the inner surface of the rotor shell.

11. The milling assembly of claim 10, wherein the support ring has a different hardness than the rotor shell.

12. The milling assembly of claim 10, wherein the surface coating of the support ring includes at least one of a nickel coating, a heat-treated region, a shot-peened region, or an anti-rust coating.

13. The milling assembly of claim 9, wherein the support ring is positioned upon a mount member that is welded to an inner surface of the rotor shell.

14. A milling machine comprising:

a frame;

a milling assembly coupled to the frame, the milling assembly including a rotor housing and a cutting rotor, the cutting rotor including a rotor shell positioned around a spindle;

a removable support ring positioned upon a mount member that is welded to an inner surface of the rotor shell, wherein the support ring is positioned between the rotor shell and the spindle, wherein the support ring is separate from the rotor shell and carries a load of the rotor shell from the spindle; and a non-metallic bushing positioned between the support ring and the spindle.

* * * * *